US005932852A

United States Patent [19]

Tyni et al.

[11] Patent Number: 5,932,852

[45] Date of Patent: Aug. 3, 1999

[54] METHOD AND APPARATUS FOR ALLOCATING LANDING CALLS IN AN ELEVATOR GROUP

[75] Inventors: Tapio Tyni; Jari Ylinen, both of Hyvinkää, Finland

[73] Assignee: KONE Oy, Helsinki, Finland

[21] Appl. No.: 08/945,028

[22] PCT Filed: Apr. 19, 1996

[86] PCT No.: PCT/FI96/00216

§ 371 Date: Oct. 21, 1997

§ 102(e) Date: Oct. 21, 1997

[87] PCT Pub. No.: WO96/33123

PCT Pub. Date: Oct. 24, 1996

[30] Foreign Application Priority Data

Apr. 21, 1995 [FI] Finland ..... 951925

[51] Int. Cl.[6] ..... B66B 1/18

[52] U.S. Cl. ..... 187/382; 187/380; 187/247; 706/13; 706/910

[58] Field of Search ..... 187/380, 382, 187/247; 706/13, 910

[56] References Cited

U.S. PATENT DOCUMENTS

| | | | |
|---|---|---|---|
| 4,935,877 | 6/1990 | Koza | 706/13 |
| 5,239,141 | 8/1993 | Tobita et al. | 187/382 |
| 5,394,509 | 2/1995 | Winston | 706/13 |
| 5,612,519 | 3/1997 | Chenais | 187/382 |
| 5,767,461 | 6/1998 | Nakagawa et al. | 187/382 |
| 5,780,789 | 7/1998 | Tsji | 187/382 |

FOREIGN PATENT DOCUMENTS

| | | | |
|---|---|---|---|
| 0565865 | 10/1993 | European Pat. Off. . | |
| 0568937 | 11/1993 | European Pat. Off. . | |
| 5-319707 | 12/1993 | Japan | B66B 1/18 |

OTHER PUBLICATIONS

L. Davis, Handbook of Genetic Algorithmms, Chapters 1–5 and 21, 1991.

*Primary Examiner*—Robert E. Nappi
*Attorney, Agent, or Firm*—Birch, Stewart,Kolasch & Birch

[57] ABSTRACT

A procedure for allocating the calls entered via landing call devices of the elevators in an elevator bank forms several allocation options. Each allocating option contains, for each active landing call, a call data item and an elevator data item which together are used to determine which elevator should service the call. The value of a cost function is calculated for each allocation option; one or more of the allocation options is repeatedly changed with respect to at least one data item, and the values of the cost functions of the new allocation options are calculated. Based on the values of the cost functions, the best allocation option is selected and the active elevator calls are allocated to the elevators in the elevator bank accordingly.

16 Claims, 5 Drawing Sheets

| Gene 1= Lift 0 | Gene 2= Lift 1 | Gene 3= Lift 2 |
|---|---|---|
| 2 | 8 | 5 |
Fig. 6
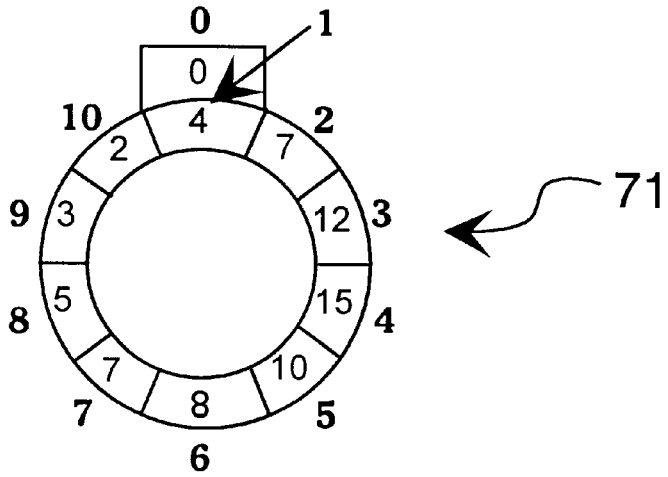
Fig. 7
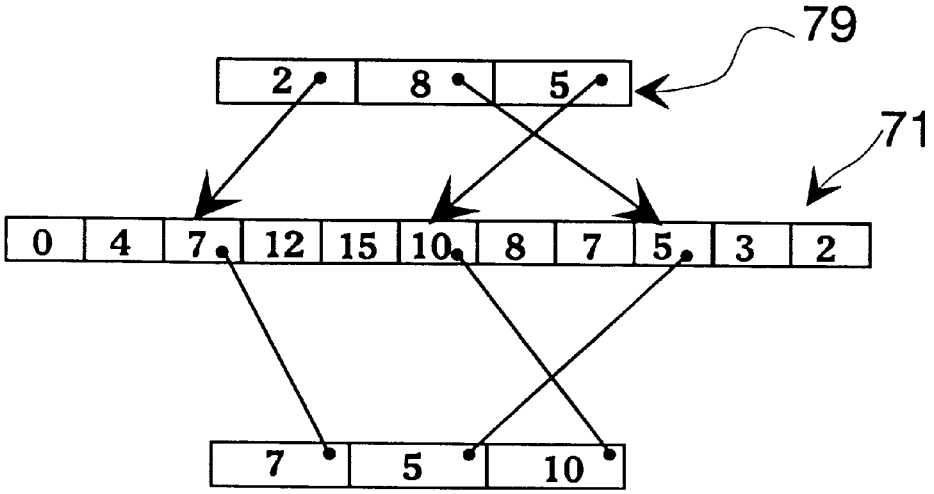
Fig. 8

METHOD AND APPARATUS FOR ALLOCATING LANDING CALLS IN AN ELEVATOR GROUP

BACKGROUND OF THE INVENTION

1. Field of the Invention

The present invention relates to a procedure for allocating the calls entered via landing call devices so that all calls will be served.

2. Description of Related Art

When a passenger wants to take an elevator from one floor of a building to another floor, he/she calls an elevator by pressing a landing call button mounted on their floor. The elevator control system receives the call and tries to determine which one of the elevators in the elevator bank will be best to serve the call. This operation is referred to as call allocation. The problem to be solved by allocation is to determining which one of the plurality of elevators will minimize a specified cost function. Allocation may involve minimizing passengers' waiting time, passengers' travelling time, the number of stoppages of the elevator or a combination of several cost factors of varying weight.

Conventionally, to establish which one of the elevators will be suited to serve a call, allocation is performed individually in each case by using complex condition structures. The ultimate aim of this operation is to minimize a cost factor describing the operation of the elevator group, typically the average waiting time for passengers. Since the elevator group has a complex variety of possible states, the condition structures are also complex and often have gaps. This leads to situations in which the control does not work in the best possible way. A typical example of this is the conventional collective control, in which each landing call is allocated to the one of the elevators which is currently closest to and moving toward the calling floor. However, this simple optimizing principle leads to an aggregation of the elevators, with the result being that the elevators travel together in the same direction, thereby deteriorating the performance of the elevator group as a whole.

When attempting to determine the cost factors of all possible alternative routes, the calculation load required may easily exceed the capacity of the processors. If the number of calls to be served is C and the building has L elevators, then the number of different alternative routes will be $N=L^C$. As the number of alternative routes increases exponentially with the number of calls, it will be impossible, even in small elevator groups, to systematically analyze all the alternatives. This has limited the application of route optimization in practice.

SUMMARY OF THE INVENTION

The object of the present invention is to achieve a new solution for allocating landing calls for the elevators in an elevator group, using a relatively low computing capacity while still achieving superior results than previous solutions and at the same time taking different alternatives sufficiently into account. The procedure present allocation scheme creates several allocation options, each of which contains for each active landing call a call data item and an elevator data item. Theses data items together define the elevator to serve the landing call. A value of a cost function is calculated for each allocation option and one or more of the allocation options are repeatedly changed with respect to at least one of the data items. The values of the cost functions of the new allocation options are calculated and the best allocation option is selected based on the values of the cost functions so as to allocate the active elevator calls accordingly to the elevators in the elevator group.

The solution of the invention substantially reduces the computational complexity as compared with calculating all possible route alternatives. The solution is based on a genetic algorithm and is applicable in a decentralized environment when the computing tasks are executed simultaneously, several elevator control computers being used to perform part of the calculations in parallel with a group control computer.

The elevator group is treated as an entity, optimizing the cost function at the level of the elevator group as a whole. The problem of allocating landing calls in the elevator group is brought to a level more general than the abstract level. The optimization process need not be concerned with individual situations and ways of coping with them. The desired operation is achieved by modifying the cost function. It is possible to optimize e.g. passenger waiting time, call time, number of starts, travelling time, energy consumption, rope wear, operation of an individual elevator if using a given elevator is "expensive", uniform use of the elevators, etc., or a desired combination of these considerations. The quantities to be optimized depend on the implementation of the system design and its accuracy. At the same time, variables are used systematically. Traffic predictions produced for the building on the basis of e.g. daily or weekly variations can be effectively utilized by changing the cost functions accordingly.

The fitness functions used in the implementation form a good basis for control systems utilizing neural networks and fuzzy logic.

BRIEF DESCRIPTION OF THE DRAWINGS

In the following, the invention is described by the aid of an example of its embodiments by referring to the drawings, in which FIG. 6 presents a call chromosome, FIG. 7 presents a call ring, and FIG. 8 illustrates the process of making an allocation decision.

DETAILED DESCRIPTION OF THE PREFERRED EMBODIMENTS

Figure 1:
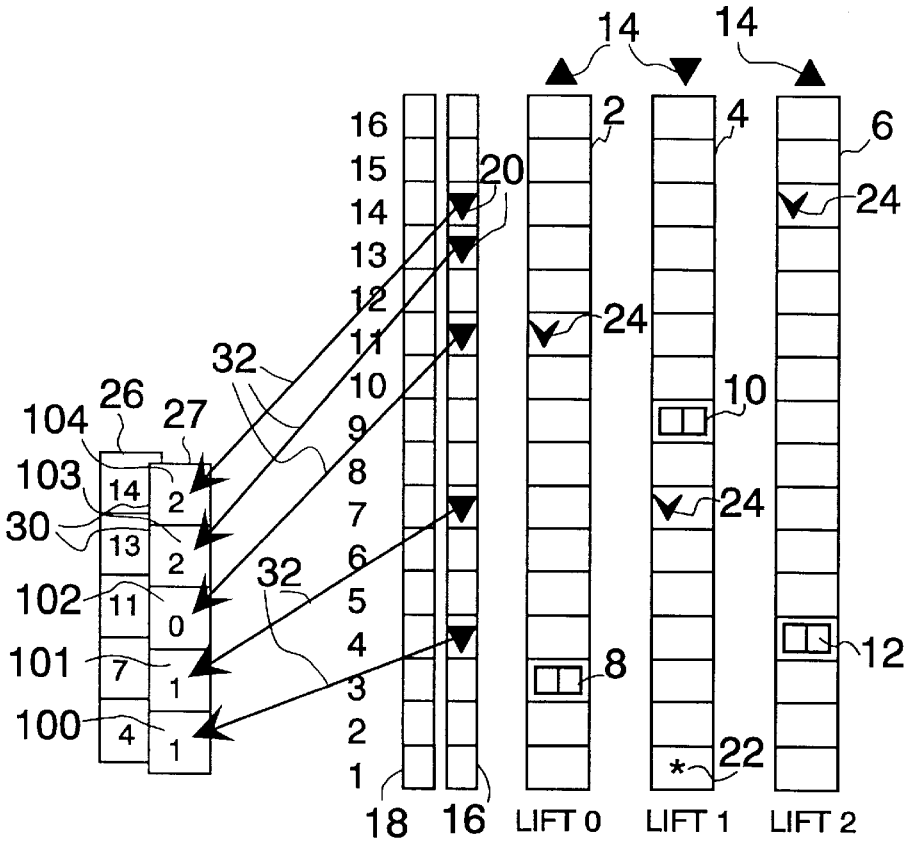
FIG. 1 illustrates the formation of an elevator chromosome.

FIG. 1 presents a diagram representing the floors in a building, the floors being numbered 1,2,3, . . . ,16. The elevator group includes of three elevators LIFT0, LIFT1 and LIFT2, which travel in shafts 2, 4 and 6 and whose elevator cars are indicated by reference numbers 8, 10 and 12, respectively. The elevator cars are located at floors 3, 9 and 4 and their travelling direction is indicated by arrow symbols 14 placed on top of the shafts, which show that elevator cars 8 and 12 are moving in the up direction and car 10 in the down direction. Two columns 16 and 18 are provided next to the shafts to present the landing calls currently active for the up and down directions. The landing calls are indicated by arrow symbols 20. The asterisk 22 symbolizes a car call to floor 1 issued from elevator car 10. Arrow symbols 24 indicate floors from which landing calls already allocated have been issued. Accordingly, a landing call from floor 11 has been allocated to elevator LIFT0, a landing call from floor 7 to elevator LIFT1 and a landing call from floor 14 to elevator LIFT2.

Columns 26 and 27 illustrate the formation of an allocation option utilized in the invention when an elevator chromosome is used, which contains one gene for each landing call. Column 26 shows the current active landing calls in sequence, with the highest floor number at the top of column 26 and the lowest floor number at the bottom of column 26 in the example in FIG. 1. Column 27 contains the elevator chromosome itself, which consists of five genes 30, the number of genes corresponding to the number of landing calls. Each gene 30 contains data identifying the elevator car serving the call, each landing call corresponding to one gene. The code of the elevator car is preferably stored in the genes in the form of a binary number LIFT0=00, LIFT1=01 and LIFT2=10. Arrows 32 show the formation of a gene. As indicated by elevator chromosome 27 and gene 102, elevator LIFT0 will serve the call from floor 11. As indicated by genes 100 and 101, elevator LIFT1 will serve the calls from floors 4 and 7, and similarly, as indicated by genes 103 and 104, LIFT2 will serve the calls from floors 13 and 14. When the elevator chromosome is being formed, the existing landing calls in the up and down directions are encoded so that the position of the gene in the elevator chromosome contains information about a landing call. After the allocation has been done, the information in the elevator chromosome is decoded for corresponding landing calls.

In the case of the embodiment in FIG. 1, according to the coding principle of a genetic algorithm, the elevator chromosome is formed in such a way that the elevator chromosome will have as many genes as there are landing calls active at the moment. The number of genes $N_{chr}=N_{down}+N_{up}$, where $N_{down}$ is the number of down calls and $N_{up}$ is the number of up calls. In the example in FIG. 1, only down calls on floors 4, 7, 11, 13 and 14 are active. Therefore, the length of the elevator chromosome in the case of this example is five genes, as represented by the chromosome 27. In this case, the number of routing alternatives according to the above description is $N=3^5=243$.

The length of the chromosome varies dynamically depending on the number of calls active at each moment, each gene corresponding to an active landing call. Each gene contains data indicating the elevator number, in other words, the allocation principle applied is to allocate one elevator for each landing call. The number of bits $N_g$ needed in a gene can be calculated from the formula $$N_g=\text{round}(\log_2(N_L)+0.5), \quad (1)$$

where $N_L$=number of elevators.

Thus, as an example, a group of eight elevators can be represented by a three-bit gene if it is agreed that the number 0 (binary number 000) corresponds to elevator 1 and the number 7 (binary number 111) to elevator 8.

The number of bits in a gene also varies dynamically, because in a real elevator group some of the elevators may be detached from the group or an elevator may be operated for inspection purposes. For example, if in an elevator group of six elevators two elevators are out of service, the remaining four elevators can be represented by a two-bit gene, in which case 0 (binary code 00) means elevator 1 and 3 (binary code 11) means elevator 4 of the elevators in use.

Figure 2:
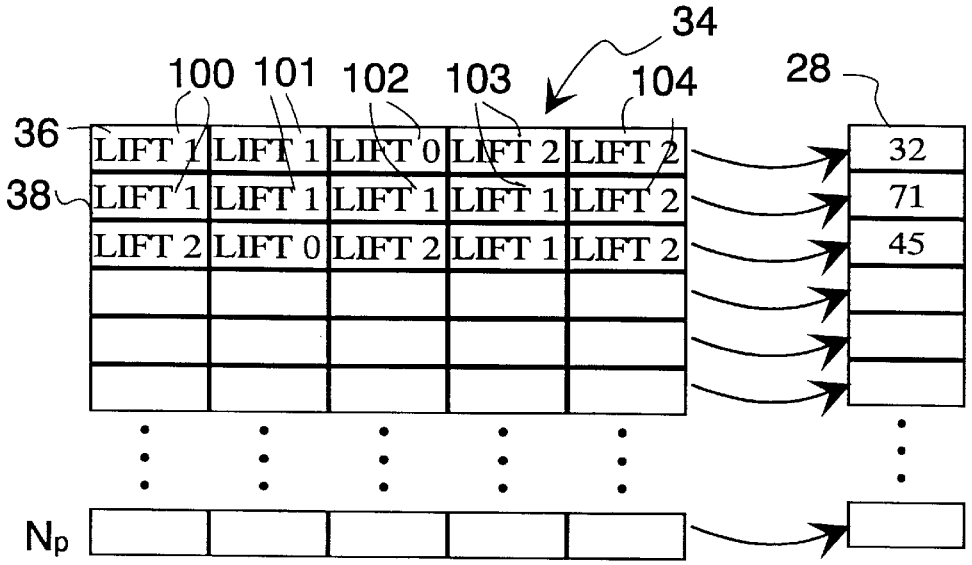
FIG. 2 presents a call population as used in the invention.

FIG. 2 presents the principle of genetic allocation after the formation of a chromosome. The chromosomes are arranged as a population 34 containing a chosen number $N_p$ of elevator chromosomes. The chromosomes 1–$N_p$, which are possible allocation alternatives for the existing calls, correspond to the situation in FIG. 1, in other words, there are five down calls from floors 4, 7, 11, 13, 14 to be served. At first, the genes of the chromosomes in the population 34 are assigned arbitrary elevator numbers or else use is made of advance information that may be available, such as the control selected during the previous allocation or collective control. According to the first elevator chromosome 36, the down calls from floors 4 and 7 (genes 100 and 101) are to be served by elevator LIFT1, the down calls from floor 11 (gene 102) by elevator LIFT0 and the down calls from floors 13 and 14 (genes 103 and 104) by elevator LIFT2. Correspondingly, according to the second elevator chromosome 38, the down calls from floors 4, 7, 11 and 13 (genes 100, 101,102 and 103) are to be served by elevator LIFT1 and the down call from floor 14 (gene 104) by elevator LIFT2. In a manner described below, a suitable number of elevator chromosomes are generated to form a population. To evaluate the quality of the allocation represented by the elevator chromosome, the value 28 of a fitness function F is calculated for each elevator chromosome. The function is of the general form $$F=F(SO,LC,CC,T), \quad (2)$$

where

SO=the initial state of the elevator group, i.e. positions and motion states of the elevators LC=landing calls allocated to the elevators CC=car calls active, i.e. car calls to be served T=traffic information, such as load situation, predictions.

The value of the fitness function F(SO,LC,CC,T) for each chromosome is the cost which will result from the elevators in the chromosome serving all the calls assigned to it, i.e. the car calls of the elevator and the landing calls allocated to it. The fitness function F can be formed in many alternative ways by selecting different cost factors to be considered or by weighting the factors of the function formed from several cost factors in different ways. As stated above, the cost factors to be considered may include e.g. passenger waiting time, passenger travelling time, number of stoppages of the elevators. For the application of the invention, it is important that the selected model describes the behavior or the elevator system as accurately as possible. The more accurate the model, the more reliable are the fitness values and, further, the better are the allocation decisions achievable by the procedure.

A new generation of the population 34 is produced when the genes of the elevator chromosomes in the population are modified by using the operators of the genetic algorithm: selection, crossover and mutation. A selection can be made from one or more earlier populations by different criteria. The alternatives giving the best fitness function are selected or one of the essential factors used in the formation of the fitness function is weighted in making a selection. Crossover involves forming a new chromosome from two chromosomes of an earlier population as illustrated by the example in FIG. 5, each element of the new chromosome consisting of elements contained in either one of the parent chromosomes.

Figure 5A:
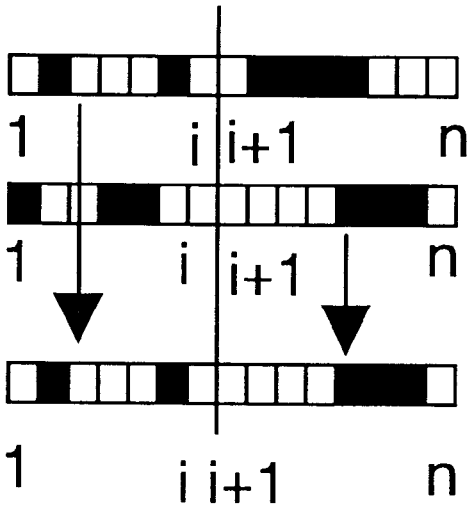
FIG. 5*a* and 5*b* illustrate crossover of elevator chromosomes.
Figure 5B:
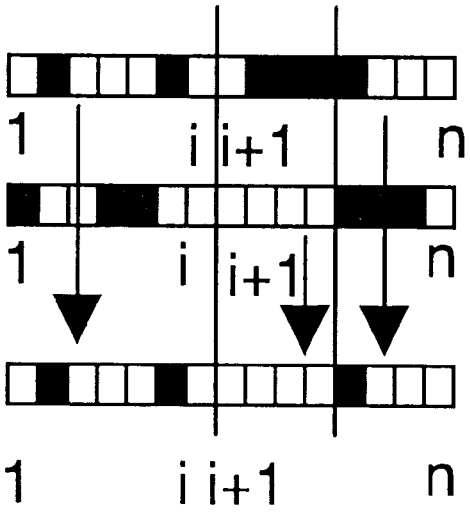

FIG. 5*a* illustrates a case of single-point crossover, in which elements 1 . . . i come from the first chromosome and elements i+1. . . n from the second chromosome, so a change of parent chromosome occurs at the point between elements i and i+1. In the case of two-point crossover as illustrated by FIG. 5*b*, a change of parent chromosome occurs at two points. In continuous crossover, the bit of the element of either parent is selected with a probability of 0.5. In mutation, the bits of the elements of the parent chromosomes are changed with a given probability to their opposite values, altering those elements in which a bit change occurs. In the generation of each new population, all the operators of the genetic algorithm can be used.

Figure 3:
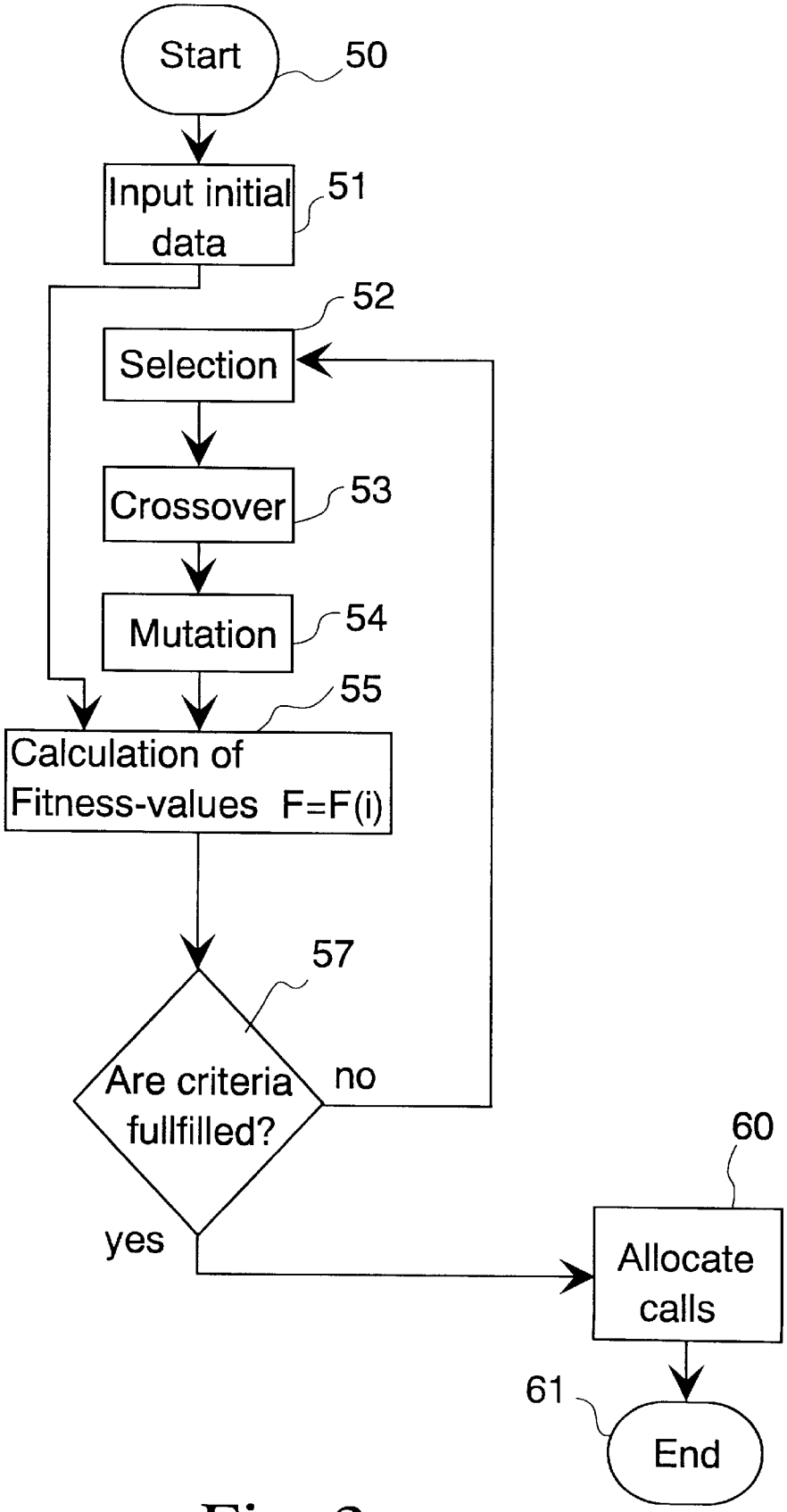
FIG. 3 presents a block diagram representing the procedure of the invention.

The block diagram in FIG. 3 presents the stages of the procedure of the invention according to one embodiment. The elevator control system activates the call allocation process (start block 50) when there is at least one landing call to be allocated to an elevator. The elevator control system inputs the initial data (block 51) to the computer in charge of optimization. At this time, among other things, the number of landing calls currently active and the number of elevators available determine the length of the elevator chromosome and the elements, respectively. In block 51, based on the initial data, a first generation of elevator chromosomes is formed. It will be advantageous to produce the first generation on the basis of an earlier allocation result or by using direct collective control as a starting point. In block 55, a so-called fitness value is determined for each one of the chromosomes in the population, which means calculating the value of a selected cost function for each chromosome. Further, based on the fitness functions, the chromosomes are evaluated in block 55 to identify the best one or ones, or otherwise viable or interesting chromosomes are selected, to be preserved at least for the lifetime of the next generation. In block 57, the fitness value $F_B$ of the best chromosome is evaluated against the result F(min) obtained in preceding generations and a check is made to see if the specified number of generations have been considered. It is not necessarily during every generation that evolution takes place, which is why the algorithm should generally be continued even if no development to the better should occur in each generation. One criterion for terminating the algorithm is that the generation shows a specified number of identical, best solutions, which often indicates that the optimum has been reached. It is also possible to define in advance an optimum result which, when reached, ends the algorithm.

Once the ending criteria are fulfilled, execution proceeds to block 60 and the calls are allocated according to the chromosome selected and, via the end block 61, control is returned to the elevator control system. If the optimization process is to be continued, execution returns to block 52 and operations belonging to the genetic algorithm are performed in blocks 52–54. In block 52, suitable chromosomes are selected for further optimization, in block 53 chromosomes of the generation are crossed over to form a new generation, and in block 54, mutations are performed. In crossover, a new chromosome is formed from two earlier chromosomes by selecting some of the genes of both. In mutation, the genes of an earlier chromosome are altered in some respect. For instance, a bit in the gene is changed with a certain probability from zero to one or from one to zero. After the genetic operations, the values of the fitness functions for the new generation are calculated in block 55.

Figure 4:
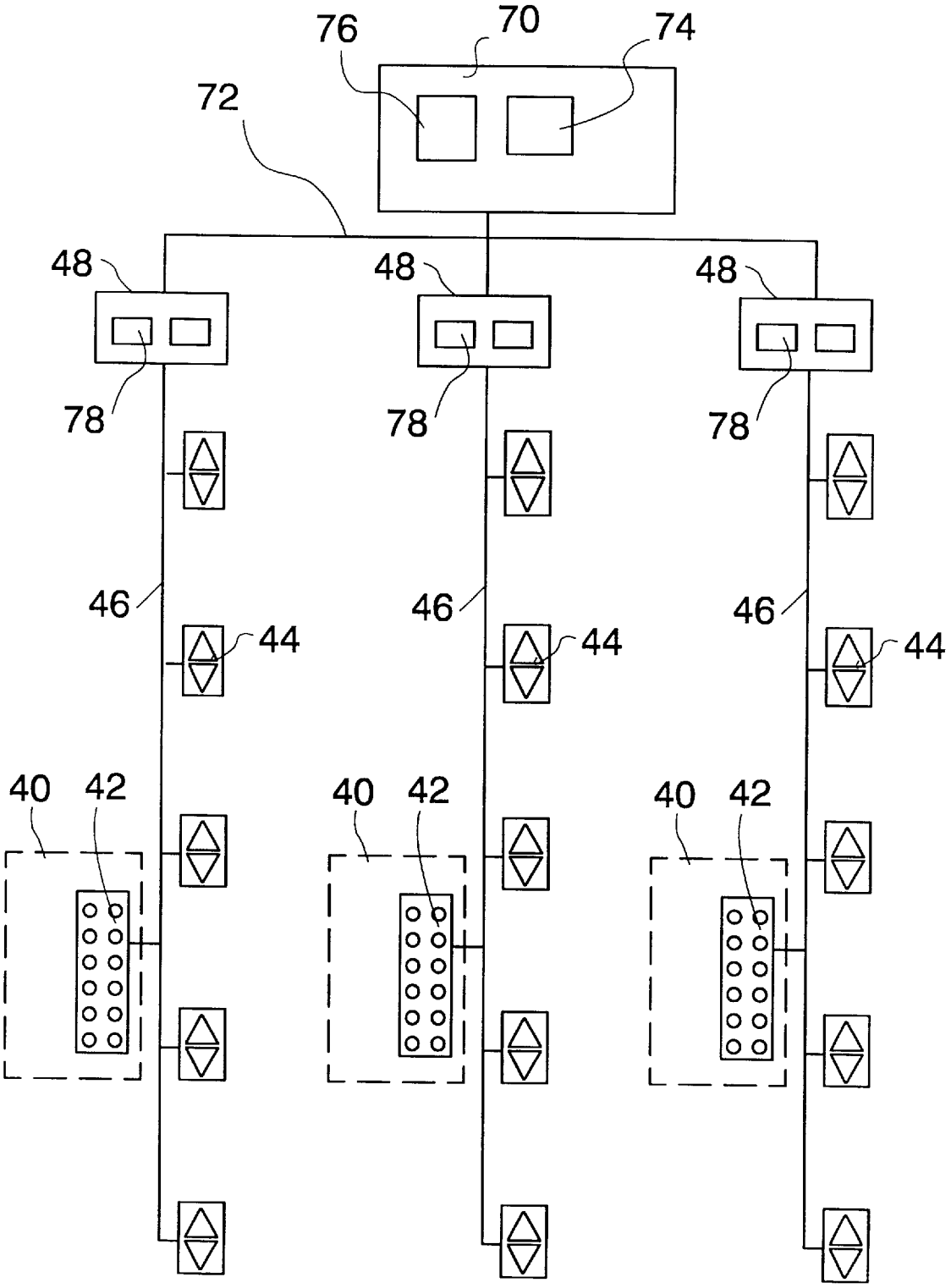
FIG. 4 presents elevator call and control equipment.

The optimization as provided by the invention is carried out by the group control and elevator control units. FIG. 4 presents the essential parts of a system in which the functions of the procedure of the invention are implemented. The figure shows an elevator group having three elevators and it also presents some elevator components associated with the invention. Elevator passengers give car calls by means of car call buttons 42 mounted in the elevator cars 40. The car calls are passed via bus 46 to the elevator control unit 48 of the elevator concerned. Each landing is provided with landing equipment including landing call buttons 44, by means of which passengers give landing calls to call an elevator to the floor. The landing call buttons are likewise connected to the elevator control unit 48 via the bus 46. In applications having no separate landing call buttons for each elevator, the calls are passed to one of the elevator control units or to the group control unit. In the embodiment in the figure, each elevator has its own control unit, and these are connected via bus 72 to the group control unit.

Provided in the group control unit 70 is a computer 74, e.g. a PC, which regularly checks if there are any landing calls from landing call devices which have not yet been served. The group control computer starts the allocation procedure and reads from a storage 76 the necessary initial data and forms the first generation of elevator chromosomes, utilizing the active landing call data of the elevators in operation and e.g. history data. For the calculation of the fitness function, a number of elevator chromosomes suitably grouped are transmitted to the computers 78 in different elevator control units. The computers 78 send the calculation results back to the group control unit, which makes the decisions about allocation or continuing the algorithm.

In another embodiment of the invention, the elevator control units also perform the operations of the genetic algorithm on the selected population and the results of these are sent to the group control unit for final selection and decision making.

In the case of minor problems, i.e. when the chromosome length is rather small, a solution is generally found during the first 20 generations. If a generation has 50 chromosomes, this requires 1000 fitness function calculations. In practice, call allocation must be performed at least twice a second, which leaves 0.5 milliseconds for one calculation. On the other hand, the genetic algorithm is of a parallel nature, i.e. the fitness function values can be calculated by parallel operations, even all at once if the system has a sufficient number of processing components. In a decentralized elevator system, the computers of different elevators calculate the fitness function values of different chromosomes of a population simultaneously. The group control computer takes care of distributing the calculation tasks within the limits of the computing capacity and data transmission links and it also performs the evaluation in a centralized manner.

Since the length of the chromosome increases with the number of calls and the number of elevators, the size of the population needed increases accordingly. Since the range of alternatives to be searched expands at the same time, the number of generations required for finding an optimum also becomes larger. Consequently, a corresponding increase in the computing capacity is needed.

In another embodiment of the invention, the allocation options are so formed that the chromosome has one gene corresponding to each elevator. In this case, the gene contains data defining the landing call, either as a binary or integer number or otherwise defined. In the following, an allocation option thus formed is termed a call chromosome. An implementation of this embodiment is described below in detail by referring to the drawings.

In this embodiment, use is made of a knowledge of how the elevator group behaves in the best possible way in the route optimization process. An experimental optimum result of route optimization for the elevator group is such that the building is divided into zones, and within the zones each individual elevator is operated by collective control. The maximum number of zones is the same as the size of the elevator group.

The principle of this procedure is that a genetic algorithm is used to determine the starting floors of the zones for each elevator, and the elevators are operated by collective control up to the floor where a new zone begins or no more landing calls to be served are present. In other words, the problem is to find for each elevator the first floor to be served, to which the elevator is to drive. Therefore, each elevator sees only one floor to which it has to move. The elevator need not necessarily serve a single landing call e.g. if the number of landing calls is less than the size of the elevator group. In that case, the elevator is given a void call. The floors seen by the elevators act as allocation options.

The elevator group serves every landing call that is active. For the service in the building, the procedure calculates a cost resulting from the allocation option, which is to be minimized. There are several allocation options, which together form a population in the genetic algorithm. A cost is calculated for each allocation option in the population, whereupon the best one/ones is/are selected, and these are used to form new allocation options according to the principles of the genetic algorithm via recombination, crossover and/or mutation of one or more allocation options acting as parents. The new allocation options constitute a new generation, and a cost is calculated for each one of the allocation options in the generation. The new generation may also contain one or more allocation options included in a previous generation or previous generations. After the costs of the allocation options of the generation have been calculated, a check is made to see if the cost resulting from the best allocation option is low enough or if the number of generations covered by the calculations corresponds to the number specified. The number of generations to be covered may be a fixed quantity or it may vary e.g. according to the number of landing calls to be served. If the criterion for ending the search for the best allocation option is fulfilled, the group control unit of the elevator group is informed about the final result obtained, or the search is continued as mentioned above.

Each elevator sees only one floor to which there is an active landing call. Therefore, the allocation option is coded on the principle of the genetic algorithm as a call chromosome in which the total number of genes equals the size of the elevator group serving the landing calls. When the size of the elevator group is L, the number of genes N=L.

The position of each gene in the call chromosome (FIG. 6) contains data referring to an elevator in the group. If the group consists of three elevators and it is agreed that their numbering starts from zero and ends at two, then the first gene in the chromosome represents elevator number 0 and the third gene, elevator number 2. The value of the gene is a reference either to a void call or one call to be served. The maximum value of the reference is the number C of calls to be served, if a void call is defined as zero, so the number of alternative references is C+1. In FIG. 6, the calls are represented by integer numbers referring to the floor from which the call has been given.

The landing calls and the void call constitute a call vector which contains data representing all landing calls active. When the call vector contains C calls to be served, there will be C+1 positions for floors. The value of a position in the call vector is the floor number of a call to be served in the building.

A logical structure of the call vector is a ring 71 (FIG. 7) in which the void call is located at the edge of the ring. The values of the genes in an individual allocation option refer to the ring or the void call. When the value of the gene refers to the ring, the route of the elevator corresponding to the gene consists of the call floor containing the reference and the floors which follow in the ring in the clockwise direction until reaching a reference of another gene in the call vector or this particular gene to the ring. The floor an elevator is to serve first is the floor to which the value of the gene corresponding to the elevator refers in the ring. When the gene refers to the void call, the elevator does not serve any landing calls in the building and no travelling route is generated for it—it cannot enter into the ring.

FIG. 7 shows a ring of ten calls to be served. The first three of these (positions 1–3 as indicated by the figures on the outer edge of the ring) are up calls while the other seven (positions 4–10) are down calls. The ring 71 and the way it is handled contain a model of collective control. Let us assume that the gene of elevator 0 refers to position 2 in the ring, the gene of elevator 1 to position 8 and the gene of elevator 3 to position 5. Thus, proceeding clockwise in the ring, elevator 0 is to serve floors 7, 12 and 15, which form its route. This elevator will not serve floor 10 as this has been allocated to elevator 2. Therefore, elevator 0 first drives up by collective control and then serves the down call from floor 15. The route of elevator 1 again is from floor 10 down to floor 7, i.e. the route consists of floors 10, 8 and 7. The elevator is operated by collective control. The zone of elevator 3 consists of floors 5, 3, 2 and floor 4, where an up call is active. Elevator 3 is also driven by collective control.

Thus, the ring contains the results of route optimization, which, based on experiments, seem to end up with an arrangement where the building is divided into zones and the elevator group is operated by collective control. To enable the strategy to be effectively implemented, the up calls to be served must be arranged in an ascending sequence and the down calls in a descending sequence. The actual starting positions of the up and down calls in the ring are not an essential question; it is only necessary that up calls be placed in succession, and down calls likewise. In the example, successive up calls start from position 1 and down calls from position 4.

However, a strategy based on zones and collective operation is not the only one feasible with the ring. Now, the elevators pick up calls in the clockwise direction until the next reference position is reached. It is possible to arrange the calls in the ring in a desired manner and make tests to see what the effect is for example on the average waiting time of passengers. One possibility is to arrange the floors from which there are calls in the same direction in a sequence according to the call times and then find the allocation solutions.

The coding of an allocation option or chromosome to produce an allocation decision is formed (FIG. 8) as follows. A check is made to see which position in the ring 71, presented in a straightened form in FIG. 8, the individual genes of the allocation option in the call chromosome 79 refer to. After this, the landing call corresponding to the position referred to is assigned to the elevator concerned.

The invention has been described above by the aid of some of its embodiments. However, the description is not to be regarded as constituting a limitation, but the implementation of the invention may vary within the limits defined by the following claims.

We claim:

1. A method for allocating elevator service to a plurality of calls previously entered by landing call devices, comprising the steps of:

forming several allocation options, each of which contains for each of said plurality of previously entered landing calls a call data item and an elevator data item which together indicate which elevator in an elevator group is to serve the corresponding previously entered landing call;

calculating a cost function value for each allocation option;

repeatedly changing one or more of the allocation options with respect to at least one data item and calculating the cost function values of the new allocation options; and selecting an allocation option based on the cost function values and allocating previously entered active elevator calls to the elevators in the elevator group accordingly.

2. The method according to claim 1, wherein an allocation option is formed as an elevator chromosome which contains one gene for each previously entered landing call, said gene containing at least an elevator data item.

3. The method according to claim 2, wherein each elevator chromosome is formed from successive elevator genes which each contain data identifying an elevator in service, and the position of the elevator gene in the elevator chromosome contains data specifying a previously entered landing call to be served.

4. The method according to claim 1, wherein an allocation option is formed as a call chromosome, each call chromosome containing a gene for each elevator, each gene containing at least one call data item.

5. The method according to claim 4, wherein each call chromosome is formed from successive call genes which contain data identifying each previously entered landing call to be served, and the position of the call gene in the call chromosome contains data specifying the elevator to serve the call.

6. The method according to claim 2, wherein a plurality of elevator chromosomes form a population whose genes are altered using a genetic algorithm, at least one data item being changed via selection, crossover or mutation.

7. The method according to claim 2, wherein elevator chromosomes are altered until a specified cost function value is reached.

8. The method according to claim 2, wherein elevator chromosomes are altered a specified number of times, and then the chromosome which yields the lowest cost function value is selected.

9. An apparatus for allocating elevators of an elevator group to service a plurality of previously entered landing calls, comprising:

option forming means for generating several allocation options, each of which contains for each of said plurality of previously entered landing calls a call data item and an elevator data item which together indicate which elevator is to serve each call;

calculating means for calculating a cost function for each of said several allocation options;

altering means for selecting and altering one or more of said several allocation options, wherein said calculating means calculates the cost function for each altered allocation option;

selecting means for selecting an allocation option based on cost functions calculated by said calculating means.

10. The apparatus according to claim 9, wherein an allocation option is formed as an elevator chromosome which contains one gene for each of said previously entered landing calls, said gene containing at least one elevator data item.

11. The apparatus according to claim 10, wherein each elevator chromosome is formed from successive elevator genes which each contain data identifying an elevator in service, and the position of the elevator gene in the elevator chromosome specifies a previously entered landing call to be served.

12. The apparatus according to claim 9, wherein an allocation option is formed as a call chromosome containing a gene for each elevator, each gene containing at least one call data item.

13. The apparatus according to claim 12, wherein each call chromosome is formed from successive call genes which each contain data identifying a previously entered landing call to be served, and the position of the call gene in the call chromosome specifies the elevator to serve the previously entered call.

14. The apparatus according to claim 10, wherein a plurality of elevator chromosomes from a population whose genes are altered by said altering means using a genetic algorithm, at least one data item being changed via selection, crossover, or mutation.

15. The apparatus according to claim 10, wherein said altering means alters elevator chromosomes until a specified cost function value is reached.

16. The apparatus according to claim 10, wherein said altering means alters elevator chromosomes a specified number of times, and said selecting means then selects the chromosome which yields the lowest cost function value.

* * * * *